US007556451B2

(12) United States Patent
Beach et al.

(10) Patent No.: US 7,556,451 B2
(45) Date of Patent: Jul. 7, 2009

(54) PRECAST CONCRETE BRIDGE AND HEADWALL ASSEMBLY AND METHOD OF PRODUCTION

(75) Inventors: Timothy J. Beach, Beavercreek, OH (US); Jeffrey Von Handorf, Waynesville, OH (US)

(73) Assignee: Contech Bridge Solutions Inc., West Chester, OH (US)

( * ) Notice: Subject to any disclaimer, the term of this patent is extended or adjusted under 35 U.S.C. 154(b) by 676 days.

(21) Appl. No.: 11/223,566

(22) Filed: Sep. 9, 2005

(65) Prior Publication Data

US 2007/0059102 A1 Mar. 15, 2007

(51) Int. Cl.
*F16L 37/00* (2006.01)
*F16L 49/00* (2006.01)

(52) U.S. Cl. ..... 405/126; 405/24; 405/26; 52/86

(58) Field of Classification Search ..... 52/86, 52/320, 259, 578; 405/124, 24, 26, 126; 138/102; 14/26
See application file for complete search history.

(56) References Cited

U.S. PATENT DOCUMENTS 1,412,616 A * 4/1922 Kammerer et al. ..... 138/102
4,390,306 A * 6/1983 Fisher ..... 405/124
4,459,063 A * 7/1984 Shaw ..... 405/124
4,563,107 A * 1/1986 Peterson ..... 405/124
4,993,872 A 2/1991 Lockwood
6,205,605 B1 * 3/2001 Orsat ..... 14/26

OTHER PUBLICATIONS

Con/Span Bridge Systems, 10" Detached Headwall, Jul. 23, 2002.

* cited by examiner

*Primary Examiner*—Richard E Chilcot, Jr.
*Assistant Examiner*—Chi Q Nguyen
(74) *Attorney, Agent, or Firm*—Thompson Hine LLP

(57) ABSTRACT

A precast steel reinforced concrete bridge unit has an arcuate top wall integrally connecting opposite side walls, and a series of precast reinforced concrete counterforts are releasably connected to the top wall of the bridge unit at laterally spaced intervals. The counterforts have vertical end surfaces spaced from an end surface of the bridge unit, and end portions of reinforcing bars project from the vertical end surfaces of the counterforts. An end surface of the bridge unit is located on a horizontal casting surface, and a reinforced concrete headwall is cast on the casting surface with the reinforcing bars depending from the counterforts embedded in the concrete forming the headwall. After curing, the concrete headwall and counterforts are removed as a unit from the bridge unit to facilitate handling and shipping of the bridge unit and headwall and counterfort unit.

16 Claims, 2 Drawing Sheets

PRECAST CONCRETE BRIDGE AND HEADWALL ASSEMBLY AND METHOD OF PRODUCTION

BACKGROUND OF THE INVENTION

In a precast reinforced concrete bridge unit having a headwall, for example, as disclosed in U.S. Pat. No. 4,993,872 which issued to the assignee of the present invention, it is known to cast the headwall as an integral part of an end bridge unit when the bridge unit is being cast, for example, as shown in the '872 Patent. It is also known to precast the headwall separately with a bottom arcuate abutment or collar which extends continuously across the arcuate top wall of the bridge unit. The collar is secured to the top wall of the bridge unit by bolts or threaded rods which extend into the top wall and are threaded into concrete anchors embedded within the top wall. The continuous arcuate collar provides for attaching the vertical headwall to the bridge unit at the construction site.

It is desirable for the headwall to be precast separately from the precast bridge unit for significantly reducing the weight of the precast bridge unit and to facilitate shipping the precast bridge unit along a roadway or highway with a semi-truck and low bed trailer vehicle. The separate precast headwall units also facilitate handling and shipping of the headwall units on a semi-truck and trailer vehicle. After all of the bridge units are positioned at the construction site with the aid of a crane, the headwall units are then positioned with the crane and attached to the opposite end bridge units.

SUMMARY OF THE INVENTION

The present invention is directed to an improved precast concrete bridge and headwall assembly and which provides for precasting the headwall units separately from the bridge units and for obtaining a precision match of each headwall unit with an end bridge unit. The precast concrete bridge and headwall assembly of the invention also reduces the volume and weight of concrete to form the assembly and thereby provides economy in construction and economy in shipping the bridge and headwall assembly in separate pieces. The reduced weight of concrete further provides for more conveniently handling the separate bridge unit and headwall unit at the construction or job site.

In accordance with one embodiment of the invention, a reinforced concrete bridge unit is precast with a top wall integrally connecting opposite side walls. The top wall of the bridge unit is provided with laterally spaced embedded anchor members in the form of internally threaded tubular anchors. A series of reinforced concrete brackets or counterforts are precast, preferably in different sizes, and each counterfort is cast with a hole for receiving a threaded bolt or rod for attaching a plurality or series of counterforts to the top wall of the bridge unit at laterally spaced intervals between the side walls of the bridge unit. The counterforts have end surfaces spaced from the end surface of the attached bridge unit and have steel reinforcing bars which project into the space.

The counterforts are releasably connected or attached to the top wall of the bridge unit, and the end surface of the bridge unit is placed on a horizontal casting surface with the reinforcing bars of the counterforts depending into the space between the end surfaces of the counterforts and the casting surface. A reinforced concrete headwall is then cast within the space on the casting surface so that the reinforcing rods of each counterfort are embedded in the concrete headwall. After the concrete forming the headwall cures, the counterforts are released from the top wall of the bridge unit so that the headwall with the integrally connected counterforts may be handled and transported as a unit separately from the precast bridge unit.

Other features and advantages of the invention will be apparent from the following description, the accompanying drawings and the appended claims.

DESCRIPTION OF THE ILLUSTRATED EMBODIMENT

Figure 1:
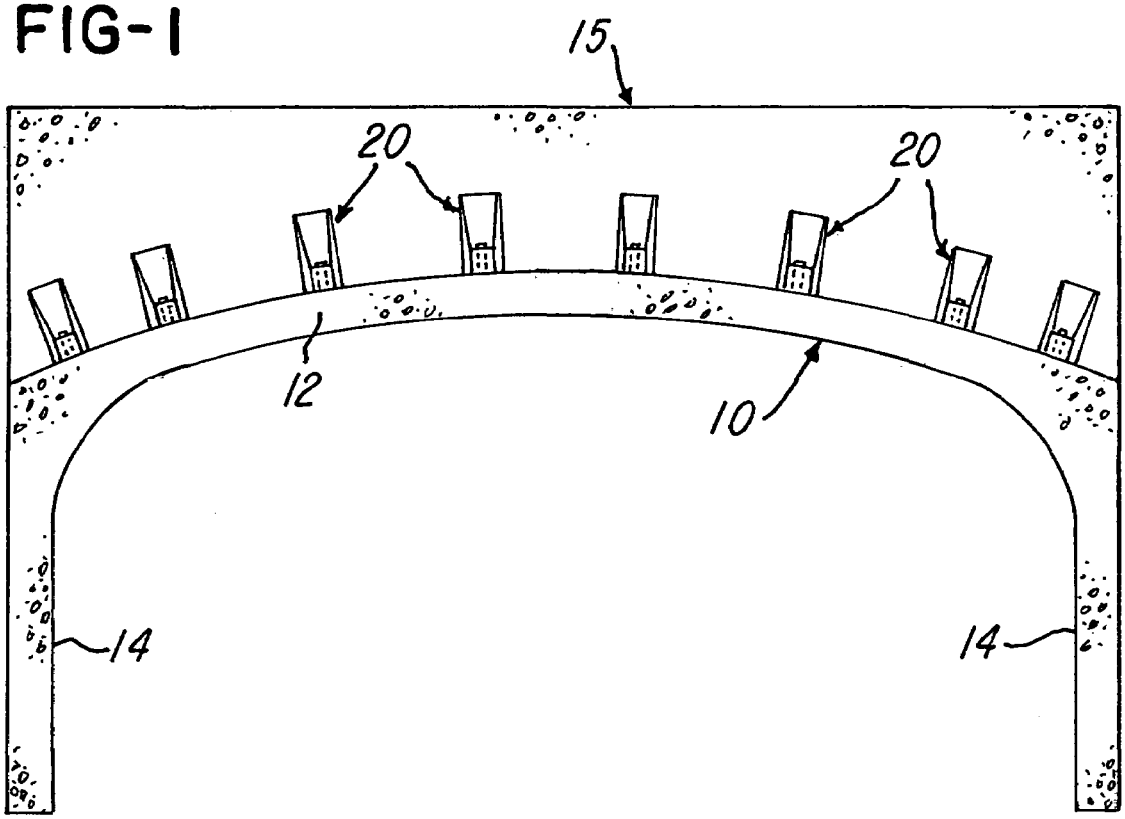
FIG. 1 is an end view of an assembly of a precast concrete bridge unit and headwall unit constructed and assembled in accordance with the invention.
Figure 2:
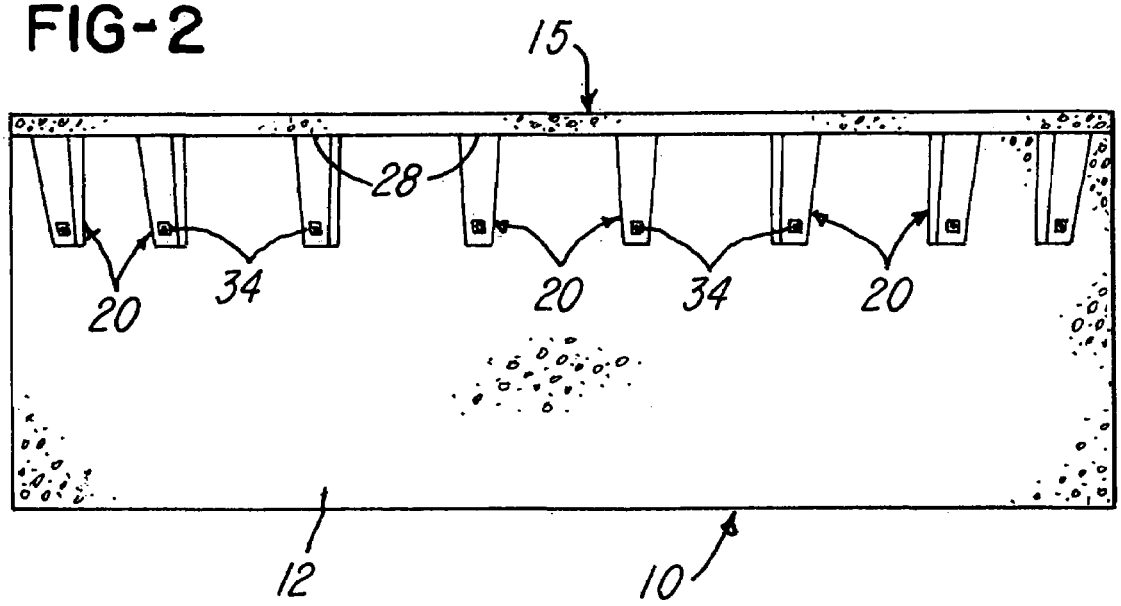
FIG. 2 is a plan view of the assembled bridge unit and headwall unit shown in FIG. 1.

Referring to FIG. 1, a precast reinforced concrete culvert or bridge unit 10 is constructed as disclosed in above-mentioned U.S. Pat. No. 4,993,872, the disclosure of which is herein incorporated by reference. The bridge unit 10 includes an arcuate top wall 12 which integrally connects parallel spaced vertical side walls 14 to form an open bottom bridge unit. However, a bridge unit may also be constructed with a bottom wall which also integrally connects the side walls 14 to form a box-type culvert or bridge unit. A separately precast steel reinforced flat concrete headwall 15 projects upwardly from one end of the bridge unit 10 and is supported by a plurality or series of precast steel reinforced concrete buttresses or counterforts 20 which preferably are tapered in two directions, as shown in FIGS. 1 and 2. For purpose of simplification, each of the counterforts 20 is illustrated as being identical. However, the counterforts may be of different sizes, for example, three different sizes, and larger counterforts may be used on opposite end portions of the headwall 15.

Figure 3:
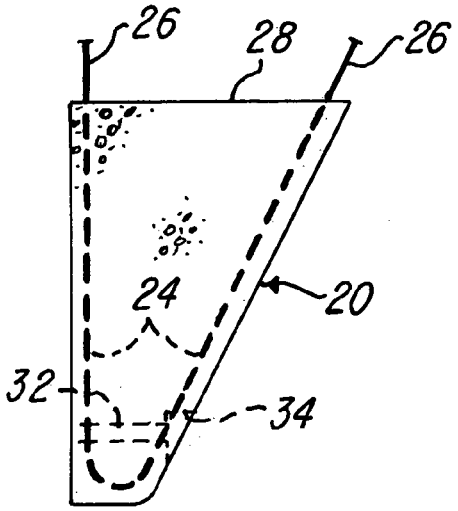
FIG. 3 is a side view of a precast counterfort constructed in accordance with the invention.
Figure 4:
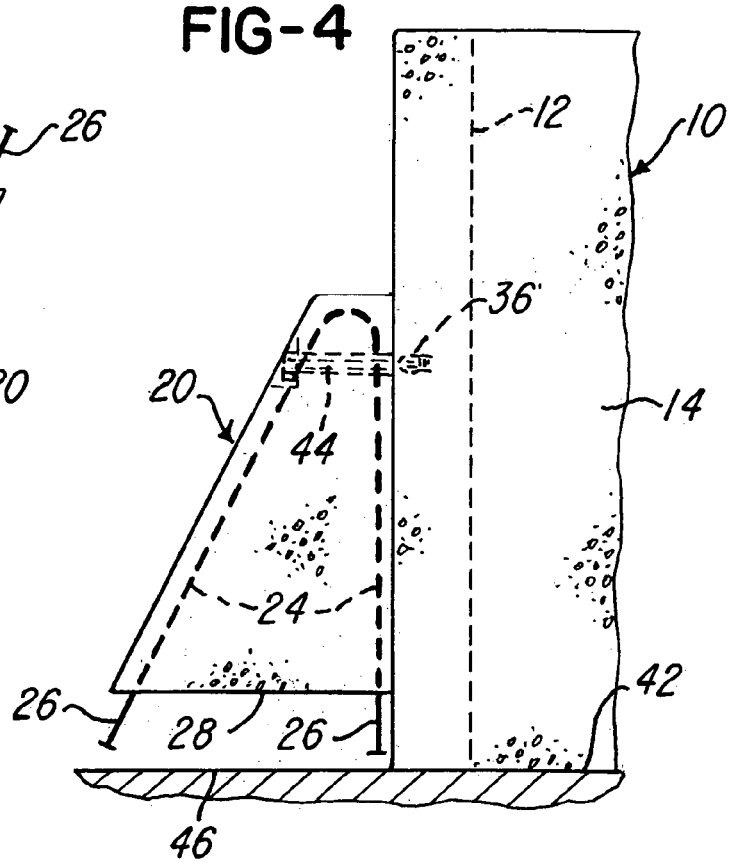
FIG. 4 is a fragmentary side view of a precast bridge unit supported by a casting surface and with a releasably attached counterfort spaced above the casting surface.

Referring to FIG. 3, each of the counterforts 20 is precast with reinforcing such as rebars 24 having end portions 26 projecting from an end face or surface 28 of the counterfort. Each counterfort 20 is also provided with a cross hole 32 which may be formed by a plastic tube and extends from a recess 34 at one end. As shown in FIG. 4, when the bridge unit 10 is precast, the arcuate top wall 12 is provided with a series of laterally spaced tubular steel anchor members 36 having internal threads and an end cap or plate. The laterally spaced embedded anchor members 36 are also located a predetermined distance from one end surface 42 of the bridge unit. Each of the counterforts 20 is releasably attached to the top wall 12 of the bridge unit 10 by a threaded steel rod and nut or bolt 44 which is threaded into the corresponding anchor member 36. The end surface 28 of each counterfort is spaced a predetermined distance from the end surface 42 of the bridge unit.

Figure 5:
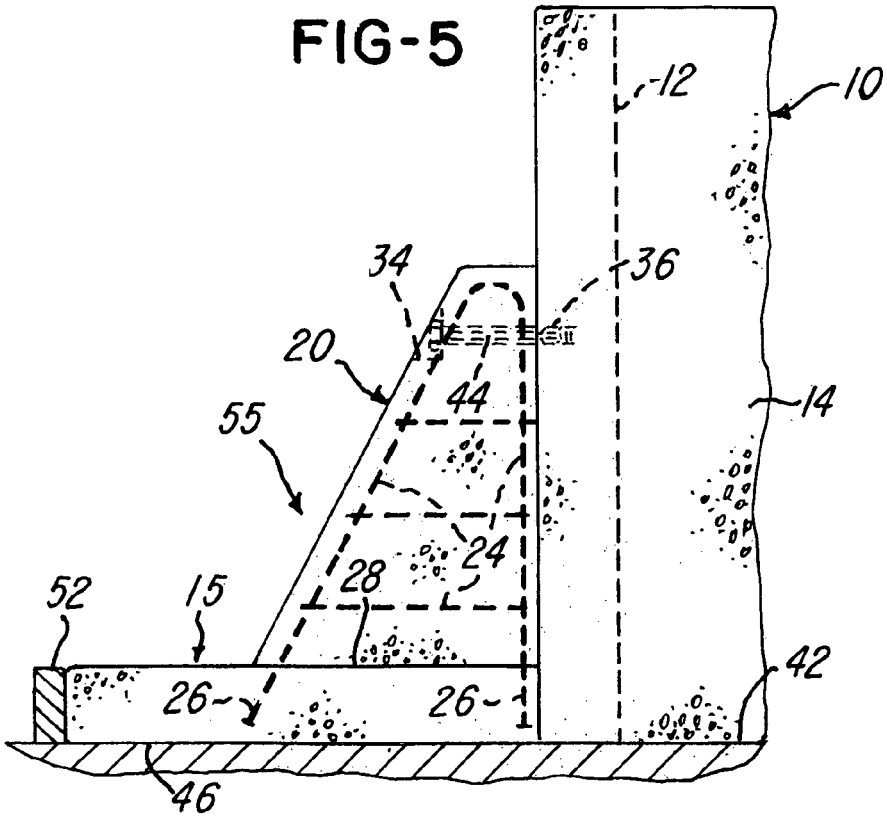
FIG. 5 is a view similar to FIG. 4 and showing a cast headwall on the casting surface and with an integrally connected counterfort.

As shown in FIG. 4, after the bridge unit 10 is cast on a casting floor or surface 46 with the arcuate top wall 12 being vertical, the laterally spaced counterforts 20 are attached to the top wall 12 with the bolts 44 and above the casting surface 46 so that the end portions 26 of the rebars 24 depend into the space defined between the co-planar end surfaces of the counterforts and the flat casting surface 46. Referring to FIG. 5, a horizontal U-shaped form member 52 is placed on the casting surface 46 to define the top end surface and side edge surfaces of the headwall 15. The concrete headwall 15 is then cast on the casting surface 46 after steel reinforcing bars (not shown) are positioned above the casting surface 46 to be embedded within the headwall 15 along with the end portions 26 of the counterfort reinforcing bars 24.

After the concrete forming the headwall 15 cures, the bolts 44 are released and removed from the anchor members 36 so that the headwall 15 and all of the connected counterforts 20 form an integral headwall and counterfort unit 55 which is separate from the precast concrete bridge unit 10. The separate units 10 and 55 may then be conveniently handled and shipped to a construction site on a low flat bed semi-trailer vehicle. For example, two of the bridge units 10 may be shipped with each unit resting on one end, as shown in FIGS. 4 and 5, and with the units nested together in opposing relation on the flat bed truck. Also, two of the headwall and counterfort units 55 may be shipped with the vertical headwalls 15 in adjacent relation and the counterforts 20 interfitting between the counterforts 20 of an adjacent unit 55. This nesting maximizes the number of units 10 and 55 that may be transported on a flat bed truck.

After the opposite end bridge units 10 are installed with a crane on the supporting concrete footers at the construction site, the combined headwall and counterfort units 55 are attached to the top wall 12 of each bridge unit with the threaded rods or bolts 44. After all of the bridge units and headwall and counterfort units 55 are backfilled with compacted soil, the soil around the attached counterforts 20 cooperates to provide for a more positive lock of the combined headwall and counterfort units 55 to the end bridge units 10. As mentioned above, the laterally spaced counterforts 20 also provide for a significant reduction in the weight of the headwall and counterfort units 55, and this reduction provides for economy in construction as well as economy in shipping and simplified handling of the units 55 with a crane at the construction site.

While the form of headwall and counterfort units herein described and the method of construction and assembly constitute a preferred embodiment of the invention, it is to be understood that the invention is not limited to the precise method and form of unit described, and that changes may be made therein without departing from the scope and spirit of the invention as defined in the appended claims.

What is claimed is:

1. A precast concrete bridge and headwall assembly comprising a precast concrete bridge unit including a top wall connecting opposite side walls, an upwardly projecting, precast concrete headwall having a bottom surface engaging and mating with said top wall of said bridge unit, a series of precast concrete counterfort members spaced laterally at intervals along said top wall of said bridge unit, each of said counterfort members being rigidly connected to said headwall, and a releasable rigid connection of each of said counterfort members to said top wall of said bridge unit.

2. The assembly as defined in claim 1 wherein said top wall of said bridge unit is arcuate, and said counterfort members are spaced laterally along an arcuate top surface of said top wall and positioned in a side-by-side arrangement extending between opposite side walls of said precast concrete bridge unit.

3. The assembly as defined in claim 1 wherein each of said precast concrete counterfort members has reinforcing members projecting from said counterfort member into said headwall and forming a non-releasable rigid connection between said counterfort member and said headwall.

4. The assembly as defined in claim 1 wherein said releasable rigid connection of each of said counterfoil members to said top wall of said bridge unit includes an internally threaded tubular anchor member embedded in said top wall, and a threaded rod extending through a hole within said counterfoil member into said anchor.

5. The assembly as defined in claim 1 wherein each of said counterfort members is tapered and has a large end portion rigidly connected to said headwall and a small end portion releasably connected to said top wall of said bridge unit.

6. The assembly as defined in claim 1, wherein said releasable rigid connection of each of said counterfort members comprises an anchor member that extends through said respective counterfort member and into said top wall such that said anchor member can be removed from said respective counterfort member and said top wall.

7. A precast concrete bridge and headwall assembly comprising a precast steel reinforced concrete bridge unit including an arcuate top wall connecting substantially vertical opposite side walls, a precast concrete headwall having an arcuate bottom surface mating with said top wall of said bridge unit, a series of precast concrete counterfort members spaced laterally at intervals along said top wall of said bridge unit, each of said counterfort members having steel reinforcing members embedded in said headwall and forming a headwall and counterfort unit, and a releasable rigid connection of each of said counterfort members to said top wall of said bridge unit.

8. The assembly as defined in claim 7 wherein said releasable rigid connection of each of said counterfort members to said top wall of said bridge unit includes an internally threaded tubular anchor member embedded in said top wall, and a threaded rod extending through a hole within said counterfort member into said anchor.

9. The assembly as defined in claim 8 wherein each of said counterfort members is tapered and has a large end portion rigidly connected to said headwall and a small end portion releasably connected by said threaded rod to said top wall of said bridge unit.

10. The assembly as defined in claim 9 wherein each of said counterfort members is generally triangular in configuration.

11. A method of producing a precast concrete bridge and headwall assembly, comprising the steps of:

casting a reinforced concrete bridge unit having a top wall connecting opposite side walls, casting a series of separate concrete counterfort members each having an embedded reinforcing member with an end portion projecting from an end surface of each counterfort member, releasably attaching the precast concrete counterfort members to the top wall of the bridge unit at laterally spaced intervals between the side walls, positioning the bridge unit with an end surface of the bridge unit supported by a horizontal casting surface and with the end surfaces of the counterfort members spaced above the casting surface and with the end portions of the reinforcing members depending from the end surfaces of the counterfort members, precasting a concrete headwall unit on the casting surface with the projecting end portions of the reinforcing members embedded in the concrete headwall unit, and removing the headwall and the counterfort members as a unit from the bridge unit.

12. The method as defined in claim 11 wherein the bridge unit is cast with an arcuate top wall, and the counterfort members are spaced along the arcuate top wall.

13. The method as defined in claim 11 wherein each of the counterfort members is cast with a generally triangular configuration.

14. The method as defined in claim 13 wherein each of the counterfort members is cast with a tapered configuration with a large end portion and a small end portion, and forming a cross hole within said small end portion.

15. The method as defined in claim 11 wherein the bridge unit is cast with the top wall integrally connecting generally vertical side walls.

16. A precast concrete bridge and headwall assembly comprising:

a precast concrete bridge unit including a top wall connecting opposite side walls;

a precast concrete headwall having a bottom surface mating with said top wall of said bridge unit; and a series of precast concrete counterfort members spaced laterally at intervals along said top wall of said bridge unit, each of said counterfort members being rigidly connected to said headwall, and a releasable rigid connection of each of said counterfort members to said top wall of said bridge unit, wherein each of said counterfort members is tapered and has a large end portion rigidly connected to said headwall and a small end portion releasably connected to said top wall of said bridge unit.

* * * * *

UNITED STATES PATENT AND TRADEMARK OFFICE

CERTIFICATE OF CORRECTION

PATENT NO. : 7,556,451 B2
APPLICATION NO. : 11/223566
DATED : July 7, 2009
INVENTOR(S) : Timothy J. Beach and Jeffrey Von Handorf It is certified that error appears in the above-identified patent and that said Letters Patent is hereby corrected as shown below:

Column 4,

Line 4, --counterfoil-- should read --counterfort--

Signed and Sealed this

Twenty-third Day of February, 2010

David J. Kappos

David J. Kappos
*Director of the United States Patent and Trademark Office*